US010406650B2

(12) United States Patent
Martin et al.

(10) Patent No.: US 10,406,650 B2
(45) Date of Patent: Sep. 10, 2019

(54) AIRFOIL MASKING TOOL AND METHOD OF POLISHING AN AIRFOIL

(71) Applicant: MDS COATING TECHNOLOGIES CORP., St. Laurent, Quebec (CA)

(72) Inventors: Lee Martin, Summerside (CA); Joshua Bell, Long River (CA)

(73) Assignee: MDS COATING TECHNOLOGIES CORP., St. Laurent, Quebec (CA)

( * ) Notice: Subject to any disclaimer, the term of this patent is extended or adjusted under 35 U.S.C. 154(b) by 0 days.

(21) Appl. No.: 14/911,372

(22) PCT Filed: Aug. 18, 2014

(86) PCT No.: PCT/CA2014/000628

§ 371 (c)(1),
(2) Date: Feb. 10, 2016

(87) PCT Pub. No.: WO2015/027310

PCT Pub. Date: Mar. 5, 2015

(65) Prior Publication Data

US 2016/0184959 A1 Jun. 30, 2016

Related U.S. Application Data

(60) Provisional application No. 62/001,425, filed on May 21, 2014, provisional application No. 61/913,439, filed on Dec. 9, 2013, provisional application No. 61/907,207, filed on Nov. 21, 2013, provisional application No. 61/870,980, filed on Aug. 28, 2013.

(51) Int. Cl.

| | |
|---|---|
| ***B24B 31/10*** | (2006.01) |
| ***B24B 31/00*** | (2006.01) |
| ***B24B 31/12*** | (2006.01) |

(52) U.S. Cl.
CPC ..... *B24B 31/003* (2013.01); *B24B 31/10* (2013.01); *B24B 31/12* (2013.01)

(58) Field of Classification Search
CPC ..... B24B 31/00; B24B 31/003; B24B 31/12; B24B 31/10
USPC ..... 451/104, 113, 29, 31, 32, 365
See application file for complete search history.

(56) References Cited

U.S. PATENT DOCUMENTS 3,435,565 A 4/1969 Blundell
3,482,423 A * 12/1969 Smith ..... B24C 1/04 451/29
3,623,278 A * 11/1971 Schwartz ..... B24B 31/104 451/113

(Continued)

FOREIGN PATENT DOCUMENTS

WO 2013/180944 12/2013

OTHER PUBLICATIONS

William B. Roberts et al, The Effect of Ultrapolish on a Transonic Axial Rotor, ASME Turbo Expo 2005 International Gas Turbine and Aeroengine Congress Reno Nevada, Jun. 6 to 9, 2005, pp. 1-7.

(Continued)

*Primary Examiner* — Robert A Rose
(74) *Attorney, Agent, or Firm* — Jeffrey S. Melcher; Melcher Patent Law PLLC

(57) ABSTRACT

An airfoil masking tool constructed to protect the leading edge, trailing edge and tip of an airfoil during polishing of the airfoil. A method of polishing an airfoil using the masking tool.

25 Claims, 5 Drawing Sheets

(56) References Cited

U.S. PATENT DOCUMENTS

| | | | | |
|---|---|---|---|---|
| 4,447,992 | A * | 5/1984 | Bergquist | B24B 31/12 451/29 |
| 6,261,154 | B1 * | 7/2001 | McEneny | B24B 29/02 451/32 |
| 6,962,522 | B1 * | 11/2005 | Kawasaki | B24B 31/003 451/104 |
| 7,014,533 | B2 * | 3/2006 | Bolz | B24B 1/00 451/104 |
| 7,066,799 | B2 * | 6/2006 | Oussaada | C23C 4/01 427/252 |
| 8,105,133 | B2 | 1/2012 | Jayabalan | |
| 8,308,526 | B2 | 11/2012 | Jayabalan | |
| 9,511,469 | B2 * | 12/2016 | Boon Beng | B24B 31/12 |
| 2004/0097170 | A1 | 5/2004 | Bolz | |
| 2009/0282677 | A1 | 11/2009 | Korn | |
| 2013/0323071 | A1 | 12/2013 | Boon Beng | |

OTHER PUBLICATIONS

International Search Report issued in PCT/CA2014/000628 dated Oct. 27, 2014, pp. 1-4.
Written Opinion issued in PCT/CA2014/000628 dated Oct. 27, 2014, pp. 1-9.
Extended European Search Report issued in European Patent Application No. 14841223.2, dated Sep. 22, 2017, pp. 1-9.

* cited by examiner

AIRFOIL MASKING TOOL AND METHOD OF POLISHING AN AIRFOIL

This application claims priority to U.S. provisional patent application Ser. Nos. 61/870,980, filed Aug. 28, 2013; 61/907,207, filed Nov. 21, 2013; 61/913,439, filed Dec. 9, 2013; and 62/001,425, filed May 21, 2014, the complete disclosures of which are incorporated herein by reference.

FIELD OF THE INVENTION

The invention relates to an airfoil masking tool and use of the masking tool in a method of polishing the airfoil.

BACKGROUND OF THE INVENTION

The demand for ever greater efficiency gains in gas turbine engines has lead to the demand for ultra-fine (low surface roughness) airfoils that have a surface roughness Ra in the region of 1 to 5 micro-inches. NASA has demonstrated that an industry-standard surface finished compressor rotor blade ultrapolished, also known by super finishing, super polishing, ultra finishing and high precision surface finishing, to a 5 micro-inch finish can produce an increase in engine efficiency of approximately 0.5%, William B. Roberts et al, *The Effect of Ultrapolish on a Transonic Axial Rotor*, ASME Turbo Expo 2005 International Gas Turbine and Aeroengine Congress Reno Nevada, Jun. 6 to 9, 2005.

It is widely known that media finishing processes, such as those recipes that are commonly provided with media finishing equipment sold by the Rosler, Sweco, Giant, Royson, etc., are able to polish most metal surfaces to achieve surface roughness Ra measurements in the region of 7 to 25 micro-inches. The media finishing process typically comprises a tub style, batch bowl, or a continuous flow-through vibratory finisher filled with hard ceramic media stones of various shapes, abrasive content and sizes, that is vibrated with an electric motor that spins an eccentric weight. Hard ceramic media is loaded into the bowl and the act of vibrating the bowl causes that media to flow in a directional manner and circulate around the bowl. Water and burnishing compounds are typically added to the bowl to assist in the polishing, and sometimes a paste or powder may also be added to accelerate the process. The articles that are to be polished are added to the bowl so that they flow around with the media. The parts can also be fixed in a stationary position in the bowl, but this is not typical. An example of a suitable polishing machine is shown in U.S. Pat. No. 6,261,154, which is incorporated herein by reference.

High energy finishing processes such as high energy tumbling or centrifugal finishing and drag-finishing are able to achieve lower surface finish conditions. However, the high energy nature of these processes can result in the loss of material at sharp edges which may harm the dimensions of the part.

When it comes to polishing close-toleranced parts such as gas turbine engine airfoils, the polishing process can be very aggressive on sharp radius edges and corners such as the leading and trailing edges of the airfoils and blade tip corners. Changes in the dimensions of the leading and trailing edges and blade tip corners can have a profoundly detrimental effect on the mechanical properties and aerodynamic efficiency of the airfoils. Thus, a process for super-polishing close-toleranced airfoils must be able to preserve the dimensions of these areas and possibly others.

SUMMARY OF THE INVENTION

An objective of the invention is to provide a super-polishing media process that will avoid altering close-toleranced dimensions of parts such as turbine blades.

Another objective is to provide an airfoil masking tool constructed to hold and protect parts of the airfoil during the polishing process.

The objectives can be obtained by a method of polishing an airfoil comprising:

- mounting an airfoil in a masking tool, the masking tool covering at least one of a leading edge, trailing edge or tip of the airfoil, to provide a mounted airfoil;
- placing the mounted airfoil in a polishing machine;
- polishing the mounted airfoil by contacting an exposed surface of the airfoil with a polishing medium at a flow angle that provides a surface roughness Ra of less than 5 micro-inches, to form a polished airfoil having a surface roughness Ra of less than 5 micro-inches; and
- removing the polished airfoil from the masking tool.

The objectives can also be obtained by using an airfoil masking tool constructed to hold an airfoil during polishing comprising:

- a body constructed and arranged to hold an airfoil in place during polishing and to cover at least one of a leading edge, trailing edge or tip of the airfoil, or any edges or surfaces of the airfoil that are to be protected from abrasion.

DETAILED DESCRIPTION OF THE INVENTION

The invention will now be explained with reference to the attached non-limiting Figs.

Figure 1:
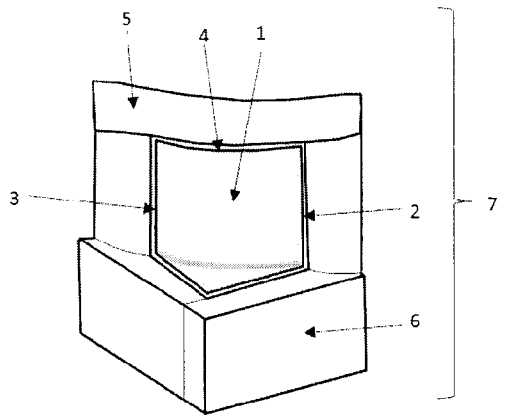
FIG. 1 illustrates a masking tool.

FIG. 1 illustrates a masking tool 7 designed to hold parts, in this case airfoils 1, during polishing. The tool 7 comprises a body 5 constructed to cover at least the leading edge 2 or trailing edge 3 or blade tip 4 of the airfoil 1, so that the polishing media contacts the exposed surface of the airfoil and cannot directly contact the leading edge 2 or trailing edge 3 or blade tip 4. The airfoil 1 can be secured in the body 5 by means of an end cap 6 to hold the airfoil root and also prevent polishing in this area. The body 5 and end cap 6 can be made of metal such as but not limited to steel, titanium, aluminum or nickel alloys or non-metallic materials such as, but not limited to rubber of varying hardness or plastic such as ABS, Nylon, reinforced Nylon, polycarbonate, polypropylene, Delran or a combination of the above. The masking tools 7 can be designed so that there is minimal wear and material loss on the masking tools 7 so that they can be used multiple times. The airfoil 1 can have a coating present on the exposed surface. This coating can be applied by physical vapor deposition methods.

Figure 2:
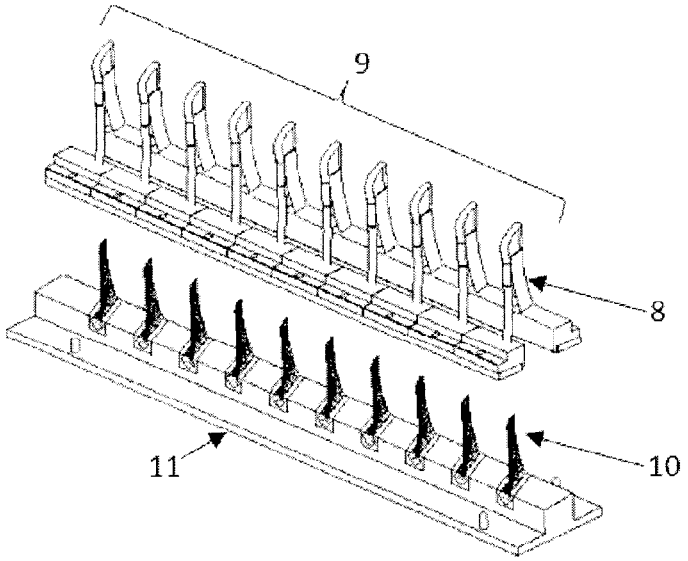
FIG. 2 illustrates the airfoil masking tools ganged together in a row.

As shown in FIG. 2, a plurality of airfoil masking tools 8 may be ganged together in a row 9 and then placed over a plurality of airfoils 10 to be polished. The plurality of airfoils 10 can be located in one of the slots of a rail 11. The masking tool assembly fits so that each airfoil leading edge, trailing edge and tip can be automatically aligned with the associated masking tool 8. Preferably, the exposed surface of the airfoils to be polished should be aligned so that the flow of polishing medium contacts the surfaces at the same angle between the medium flow direction and the orientation of the leading edge/trailing edge chord axis of the airfoils; termed the flow angle.

Figure 3:
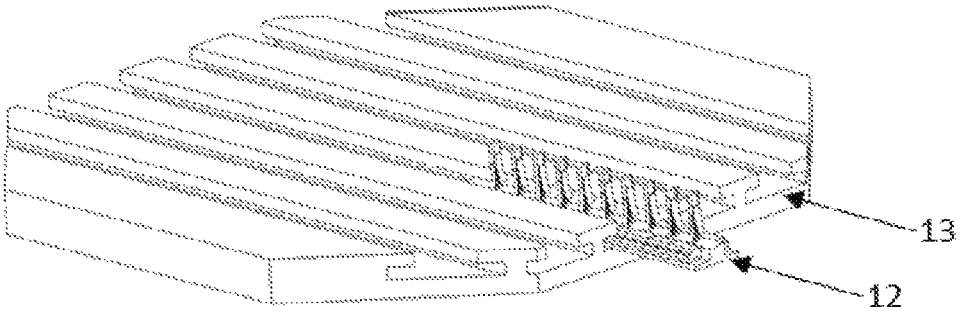
FIG. 3 illustrates a base plate.

The rail of blades 12 or individual masking tools 7 can then be fitted onto a base plate 13 as shown in FIG. 3. Multiple rails of blades 12 that can be of the same size and shape, but may also be of different part designs that can be loaded into adjacent slots on a base plate 13. The fully loaded base plate 13 can then be secured in the polishing machine, for example a tumbling machine. Equally, the blades may be organized in other patterns, such as a curve or staggered arrangement, as an alternative to the linear arrangement shown in FIG. 3. Additionally, the masking tooling may be secured on a ferromagnetic base plate by means of a magnetic component to hold the tooling and blade in the correct position without the need for a rail. Additionally, blades may be mounted into other tooling structures more suited to the type of polishing machine to be used as exemplified but not limited to tumbling or drag finishing machines.

Figure 4:
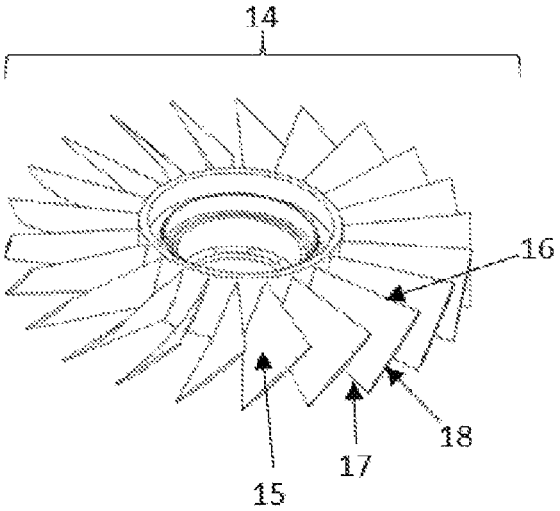
FIG. 4 illustrates a bladed disc or rotor.
Figure 5:
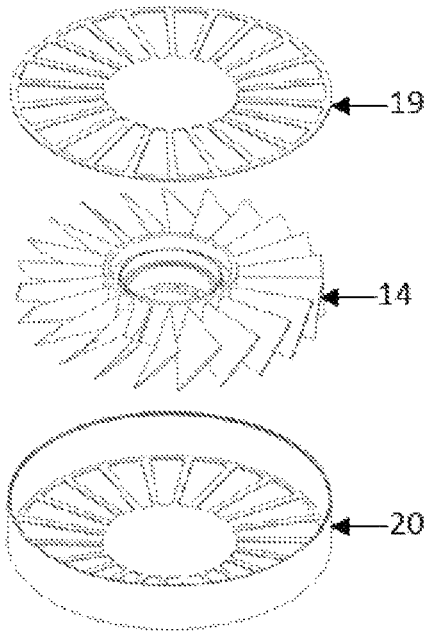
FIGS. 5 and 6 illustrate a bladed disc or rotor with masking tooling.
Figure 6:
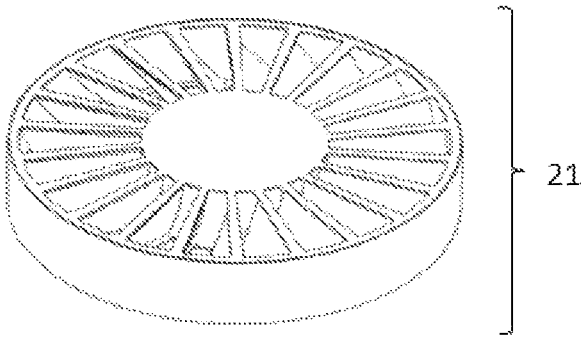

Bladed discs or rotors 14, as shown in FIG. 4, are well known engine components that comprises of airfoils 15 that are integral to the rotor hub. The leading 16 and trailing edges 17 and blade tips 18 can be protected using masking tooling 19, 20, as shown in FIG. 5 and as a complete assembly 21 in FIG. 6 in order to prevent excessive material removal during the tumbling process. The masking tooling can be made from metal such as but not limited to steel, titanium, aluminum or nickel alloys or non-metallic materials, such as, but not limited to rubber of varying hardness' or plastic such as ABS, Nylon, reinforced Nylon, polycarbonate, polypropylene, Delran or a combination of the above.

Figure 10:
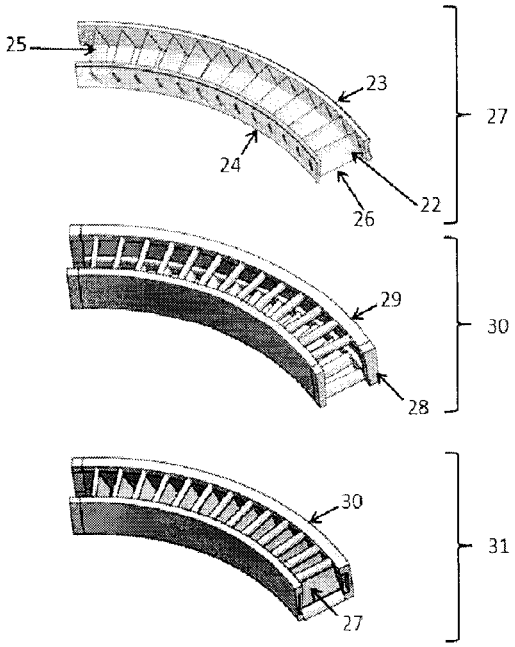
FIG. 10 illustrates a vane sector with masking tooling

Vane sectors 27, as shown in FIG. 10, are well known engine components that comprise airfoils 22, an outer shroud 23, and an inner shroud 24 into which the airfoils are attached. The leading 25 and trailing 26 edges of the airfoils can be protected by using a masking tool 30 comprising of two parts; and upper 29 and a lower 28 part; and as a complete assembly 31 in FIG. 10 in order to prevent excessive material removal during the polishing process. The masking tooling can be made from metal such as but not limited to steel, titanium, aluminum or nickel alloys or non-metallic materials, such as, but not limited to rubber of varying hardness' or plastic such as ABS, Nylon, reinforced Nylon, polycarbonate, polypropylene, Delran or a combination of the above.

Figure 9:
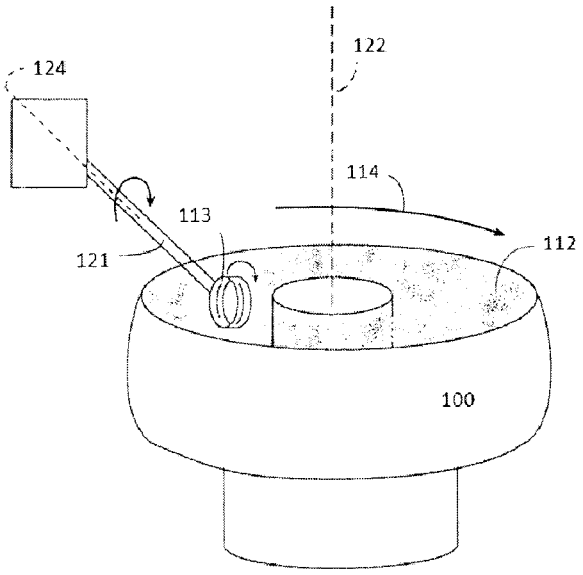
FIG. 9 illustrates a polishing machine.

The present invention can utilize any suitable polishing machine for mass finishing the surface of workpieces, in particular the airfoil masking tool holding the airfoil. FIG. 9 illustrates an exemplary embodiment of a suitable polishing machine. The polishing machine comprises a container or tub 100 which FIG. 9 illustrates as being circular or toroidal in its shape, and which—in this and related shapes—is referred to as a "bowl." In its dictionary definition, the term "toroid" refers to "a surface generated by a plane closed curved rotated about a line that lies in the same plane as the curve but does not intersect it" (Merriam-Webster's Collegiate Dictionary, 10$^{th}$ Edition, 1993). The shape is more colloquially referred to as resembling a doughnut. It will be understood that although a toroid is the best method of describing the shape of this embodiment of the bowl 100, that the invention is not limited to this particular shape nor should the term "toroid" as used herein, be limited to structures that meet the rigorous mathematical definition. Those familiar with solid geometry and the like will of course recognize that the functional equivalent of a toroid could be made using slightly different shapes, but that these would fall within the claims of the invention. Other container shapes that can be used with the present invention include, but are not limited to, troughs, ovals, and racetrack shapes.

The tub 100 holds a finishing media which is generally designated by the dotted portions 112. The finishing media is a collection of small objects, usually selected to be uniform in shape, size, and composition, which strike a workpiece to be finished and carry out a polishing or abrading action upon it. The nature and type of finishing media selected for use with the invention is not critical to the invention, but exemplary media include natural stone, sand, porcelain, ceramic particles of various shapes and sizes, metal balls, certain natural organic media (e.g. walnut shells), or polymer-based materials or hybrid multi-component media (e.g. plastic or porcelain with embedded abrasive particles such as diamond). The individual pieces of the media are also referred to as "working bodies" to differentiate them from the workpieces being finished. In FIG. 9, the workpiece 113 to be polished is illustrated as the open wheel 113. It will be understood that although a simple open wheel is illustrated, the invention offers significant advantages for workpieces of much more complex shape, as shown by the airfoil in the attached Figs., and that the simple illustration of FIG. 9 is included for schematic and illustrative purposes rather than as any limitation of the claimed invention.

The invention further comprises means for moving the media 112 in the tub 100 in a generally revolving motion that is indicated by the arrow 114 in FIG. 9. The control of the media 112 in the tub 100 is generally well understood in this art and will not be discussed in detail herein. Exemplary discussions of the manner in which the motion of the tub 100 can be used to move the media 112 are set forth, for example, in U.S. Pat. No. 3,464,674 at Column 3, line 26 though Column 4, line 38, and U.S. Pat. No. 4,428,161, the complete disclosure of both which are incorporated herein by reference. For example, a motor can be flexibly mounted to the tub and an eccentrically-mounted weight on a motor shaft can be used for vibrating the motor and the tub when vibrations are desired.

One embodiment of the invention is shown in FIG. 9, which utilizes a positioning and rotating device, examples shown as the rotating shaft or spindle 121, for positioning and rotating the workpiece 113 that is to be polished in the media 112. The shaft 121 may rotate or hold the workpiece 113 stationary about an axis 124 that is oblique to the axis 122 about which the media revolves, and does so without moving the position of the workpiece 113 with respect to the tub 100 as the workpiece 113 is held or rotated. The workpiece 113 can be made to hold stationary or rotate the workpiece at any angle to the axis 124 to produce the best desired orientation for polishing the workpiece 113. Instead of using the positioning and rotating device, the workpiece can be mounted in a fixed position inside the tub 100.

In addition to the two non-limiting examples of polishing machines disclosed herein, other polishing machines can be used. The invention is applicable to any polishing machine capable of adjusting the angle of the flow of the polishing media in relation to the workpiece being polished. By specifically aligning the airfoils and protecting the leading edge, trailing edge and tip, the exposed surfaces of the airfoils can be polished to higher degree. Preferred polishing machines are a tumbling machine, a high energy centrifugal barrel finishing machine or a drag finishing machine. A preferred medium is ceramic. The polishing machine should be constructed to flow the medium with or without an abrasive paste at desired flow angles against the exposed surfaces of the airfoils. Preferably, the flow angle is selected to provide a surface roughness Ra of less than 5 micro-inches. Examples of suitable flow angles are 50 to 0 degrees, more preferably 40 to 10 degrees, and most preferably 20 to 10 degrees, to the orientation of the leading edge/trailing edge chord axis of the airfoils.

In tumbling machines having two side vibration motors, one can be set at 0 to 50 degrees, and more preferably +10 to 40 degrees, and more preferably +10 to 20 degrees and the other side motor at 0 to −50 degrees, and more preferably −10 to −40 degrees, and more preferably −10 to −20 degrees. However the motor orientation can be altered to change the flow angle of media as necessary such that the flow angle is within 50 to 0 degrees and more preferably 40 to 10 degrees, more preferably 30 to 10 and most preferably 20 to 10 degrees at the desired angle to the orientation of the leading edge/trailing edge chord axis of the airfoils.

Bladed discs or rotors 14, as shown in FIG. 4, are well known engine components that comprises of airfoils 15 that are integral to the rotor hub. The leading 16 and trailing edges 17 and blade tips 18 can be protected using masking tooling 19, 20, as shown in FIG. 5 and as a complete assembly 21 in FIG. 6 in order to prevent excessive material removal during the tumbling process. The masking tooling can be made from metal such as but not limited to steel, titanium, aluminum or nickel alloys or non-metallic materials, such as, but not limited to rubber of varying hardness' or plastic such as ABS, Nylon, reinforced Nylon, polycarbonate, polypropylene, Delran or a combination of the above.

A preferred medium for polishing metallic airfoils comprises ceramic media, such as the RCP porcelain non-abrasive polishing stones that can be acquired from Rösler along with a Rösler RPP6279 abrasive paste. However, these media are usually not suitable for polishing airfoils that are coated with an erosion resistant coating such as Balck-Gold®. Surprisingly, a method that was found to produce a surface finish to levels below 4 μin was a medium comprising diamond paste. The paste used to polish the BlackGold® coating was comprised of a one-micron diamond powder with a gum that serves to keep the diamond powder on the surface of the ceramic media and a water soluble oil, commonly used in metallographic polishing, that assists in the acceleration of the polishing process.

Preferably the polishing paste comprises a polishing media and a carrier. The polishing media can be any media suitable for polishing an airfoil. Examples of suitable media include, but are not limited to, ceramic and diamond. Any suitable carrier for the media can be used. Preferred carriers comprise gum, water and oil.

A preferred polishing paste comprises the following components:

at least one gum in the range of 4 to 24 mL, preferably 8 to 16 mL, more preferably 10 to 13 mL;

at least one water soluble oil in the range of 26 to 104 mL, preferably 26 to 78 mL, and more preferably 45 to 65 mL;

water in the amount of 1 to 3 L; preferably 1 to 2 L and more preferably 1 to 1.6 L;

at least one ceramic media, with the amounts being per 100 kg of ceramic media. The amounts of the components can be adjusted up and down within these ranges for any desired amount of ceramic media. When polishing a coated airfoil, the polishing paste preferably further comprises at least one diamond powder in the range of 26 to 156 grams, preferably 52 to 104 grams, and more preferably 65 to 78 grams.

Examples of suitable polishing paste compositions comprise:

Diamond powder in the range of 100 to 600 grams, preferably 200 to 400 grams and more preferably 250 to 300 grams;

Gum in the range of 15 to 90 mL, preferably 30 to 60 mL and more preferably 40 to 50 mL;

Water soluble oil in the range of 100 to 400 mL, preferably 100 to 300 mL, and more preferably 150 to 200 mL;

Water in the range of 3 to 10 L, preferably 4 to 7 L and more preferably 4 to 5 L; and Rösler RCP media in the range of 200 to 600 kg, preferably 300 to 500 kg and more preferably 360 to 410 kg.

The invention is also suitable for fine adjustments to a structure of the airfoil or other desired workpiece. For example, the polishing can be conducted to remove a desired portion of the airfoil to change or alter a dimension or shape of the airfoil. For example, the airfoil can be machined or cast into a desired shape and then fine adjustments to the shape can be performed at the same time as polishing, by controlling the flow of media over the surface of the part such that the action of the media is more heavily concentrated in the area where a dimensional adjustment is required. The surface of any desired portion of the airfoil can be removed at the same time as polishing. This method is suitable for controlled removal of material ranging from 1 micron up to one millimeter in thickness of material from the airfoil.

The polishing method will be further described with reference to the following non-limiting examples.

EXAMPLES

The process for the super-finishing of parts such as turbine blades comprises of the following components:

Example 1

1. Tumbling Machine

The example of the tumbling machine used in this embodiment of the process was a Walter Trowal MV-25

2. Ceramic Media

The ceramic media used in this process can be almost any media that is suitable for contacting all areas of the part to be polished. One embodiment of this process used Rosier RCP porcelain non-abrasive polishing stones to process the parts.

3. An Abrasive Paste

The abrasive used in this process comprises:

2.5 Kg Rosler paste (RPP6279), or Rosler RPP579, or Walther Trowel SDB Trowapast PKP 5 L water And was a suitable quantity to use with 800-900 lbs Rosier RCP media.

4. Stationary Fixed Parts

Airfoils protected with masking tooling similar to that described here were mounted on a base plate and loaded into the tumbling machine and were held stationary on a plate in the tumbler as shown in FIG. 3.

The Walter Trowal MV-25 tumbling machine is equipped with three vibrator motors; two on the side and one on the base. The two side motors can be oriented individually about 360 degrees. In the present example, the two side motors were set to 10 degrees from the horizontal; one at +10 degrees and the other at −10 degrees.

During operation the three motors were set to 100% power. The media flows in one direction, for example generally from the leading edge to trailing edge of the airfoils, and every 14 minutes the medium flow was reversed automatically by the machine so that the medium flow direction was generally from trailing edge to leading edge and then from leading edge to trailing edge. This cycle was repeated for 5 to 5½ hours. Longer or shorter time periods can be used as required to achieve the required surface finish.

Once the polishing run was completed the media parts were rinsed with water and a 2-5% by volume of a burnishing compound (brand name Rosier FC120) for 45 minutes to an hour. At this point the process was complete and the polished parts were removed from the media. The surface roughness Ra was less than 5 micro-inches.

Example 2

Figure 7:
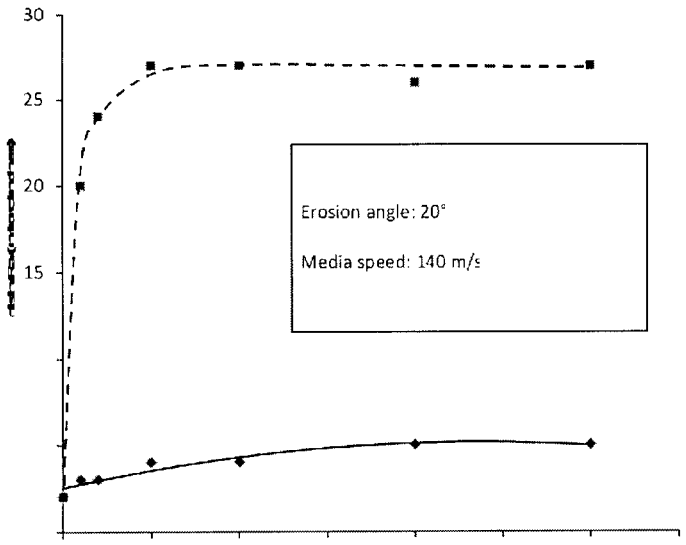
FIG. 7 illustrates a graph of the results of an erosion test.
Figure 8:
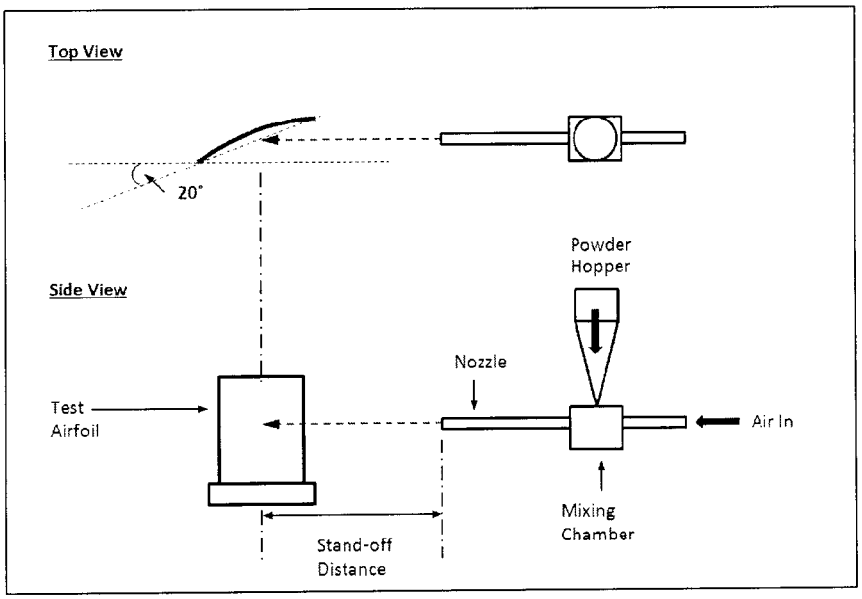
FIG. 8 illustrates an erosion test procedure.

The same process as Example 1 was used to super polish airfoils that were first coated with an erosion resistant coating, MDS Coating Technologies' BlackGold® coating. The erosion resistant coating was applied to the airfoils and once polished according to the present invention to a surface finish (Ra) of less than 4 μin. The surface finish retention of the coated and polished surface was compared to an uncoated surface having a surface finish (Ra) of less than 4 μin by subjecting the polished coated and uncoated surfaces to erosion using Arizona road dust as the abrasive media. FIG. 7 illustrates the results of the erosion test. The results shown in FIG. 7 demonstrate that the polished coating prolonged and maintained the surface finish in erosive conditions to an Ra of less than 10 μin. In contrast, the uncoated polished surface at the same conditions resulted in a surface finish Ra of 34 μin. The erosion test procedure is shown schematically in FIG. 8.

The abrasive paste for polishing coated gas turbine blades (Example 1, Item 3) is:

275 g of 1 micron diamond powder
45 mL xanthan gum
200 mL water soluble oil—Anamet Rust Inhibitor
4-5 L water
And was a suitable quantity to use with 360-410 kg Rosier RCP media.

While the claimed invention has been described in detail and with reference to specific embodiments thereof, it will be apparent to one of ordinary skill in the art that various changes and modifications can be made to the claimed invention without departing from the spirit and scope thereof.

We claim:

1. An airfoil masking tool constructed to hold an airfoil during polishing comprising:

a body constructed and arranged to hold an airfoil in place in a polishing machine during polishing and to cover a leading edge, trailing edge and tip of the airfoil to protect the leading edge, trailing edge and tip from abrasion from a moving polishing media during polishing and the polishing media contacts an exposed surface of the airfoil during polishing, and optionally cover any edges or surfaces of the airfoil that are to be protected from abrasion, wherein each of the leading, trailing and tip are aligned with the masking tool when the airfoil is mounted in the masking tool, and further comprising a mount configured to mount the masking tool in a stationary position within the polishing machine to set an angle between the moving polishing media and the airfoil held in place within the making tool.

2. The airfoil masking tool according to claim 1, further comprising a plurality of masking tools aligned in a rail.

3. The airfoil masking tool according to claim 1, further comprising a plurality of masking tools connected together in a row.

4. The airfoil masking tool according to claim 1, wherein the mount comprising a magnetic base plate.

5. An apparatus for finishing the surfaces of an airfoil comprising:

a tub;
finishing media in the toroidal tub;
a motor for moving the polishing media in the tub in a generally revolving helical motion in the tub;
an airfoil masking tool comprising a body constructed and arranged to hold an airfoil in place during polishing and to cover a leading edge, trailing edge and tip of the airfoil to protect the leading edge, trailing edge and tip from abrasion from a polishing media during polishing and the polishing media contacts an exposed surface of the airfoil during polishing, wherein each of the leading, trailing and tip are aligned with the masking tool when the airfoil is mounted in the masking tool; and
a mount constructed to mount the masking tool in a stationary position within the tub at a selected flow angle of the moving polishing media flowing against the exposed surface during polishing.

6. An apparatus according to claim 5, wherein said media is selected from the group consisting of: sand, stone, metal, porcelain, natural organic materials, ceramics and polymeric compositions or hybrid multi-component media.

7. An apparatus according to claim 6, wherein said media further comprises a chemical composition.

8. An apparatus according to claim 5, wherein the shape of the tub is selected from the group consisting of toroids, bowls, troughs, ovals and racetrack shapes.

9. A method of polishing an airfoil comprising:

providing a polishing machine containing a polishing media;
mounting an airfoil in a masking tool, the masking tool covering a leading edge, trailing edge and tip of the airfoil, to provide a mounted airfoil having an exposed surface to be polished, wherein each of the leading, trailing and tip are aligned with the masking tool;
mounting the mounted airfoil in the polishing machine at a stationary position set at a flow angle of the polishing media in relation to the exposed surface that provides a surface roughness Ra of less than 5 micro-inches during polishing;
polishing the mounted airfoil by contacting the exposed surface of the airfoil with the polishing medium at the flow angle to form a polished airfoil having a surface roughness Ra of less than 5 micro-inches, wherein the masking tool prevents alterations to the leading edge, trailing edge and tip of the airfoil during polishing; and
removing the polished airfoil from the masking tool.

10. The method according to claim 9, further comprising mounting a plurality of mounted airfoils on a base plate and mounting the base plate in the polishing machine so that exposed surfaces of the airfoils are aligned and conducting the polishing so that the polishing medium contacts the exposed surfaces of the airfoils at a selected flow angle.

11. The method according to claim 9, wherein the flow angle is from 50 to 0 degrees to the orientation of the leading edge/trailing edge chord axis of the airfoils.

12. The method according to claim 9, wherein the airfoil is coated with an erosion resistant coating.

13. The method according to claim 12, wherein the polishing media comprises an abrasive diamond polishing paste.

14. The method according to claim 13, wherein the polishing process time to achieve the desired surface finish is shorter than the for an uncoated airfoil.

15. The method according to claim 12, wherein the surface finish of the polished coated article remains significantly smoother for an extended duration compared to a polished uncoated article in erosive conditions.

16. The method according to claim 12, wherein the material loss from the polished surface of the polished coated article is minimized when compared to a polished uncoated article.

17. The method according to claim 13, wherein the polishing media comprises:

diamond powder in the range of 26 to 156 grams;
gum in the range of 4 to 24 mL;
water soluble oil in the range of 26 to 104 mL; and
water in the range of 1 to 3 L per 100 kg of abrasive media.

18. The method according to claim 13, wherein the polishing media comprises:

diamond powder in the range of 52 to 104 grams;
gum in the range of 8 to 16 mL;
water soluble oil in the range of 26 to 78 mL; and
water in the range of 1 to 2 L per 100 kg of abrasive media.

19. The method according to claim 13, wherein the polishing media comprises:

diamond powder in the range of 65 to 78 grams;
gum in the range of 10 to 13 mL;
water soluble oil in the range of 45 to 65 mL; and
water in the range of 1 to 1.6 L per 00 kg of abrasive media.

20. The method according to claim 9, wherein the polishing process further comprising making a fine adjustment to a dimension or shape of the airfoil by a controlled removal of material in a desired location.

21. A method of making a fine adjustment to a dimension or shape of an airfoil using the method of claim 9, comprising controlling a flow of the polishing media over the exposed surface of the airfoil such that an action of the polishing media is more heavily concentrated in an area where a dimensional adjustment is required.

22. The method according to claim 21, wherein from 1 micron up to one millimeter in thickness of material is removed from the airfoil.

23. The method according to claim 10, wherein the base plat comprises a magnetic base plate.

24. The apparatus according to claim 5, wherein the mount comprises a base plate configured to mount the masking tool in a stationary position within the polishing machine to set an angle between the moving polishing media and the airfoil held in place within the making tool.

25. The apparatus according to claim 24, wherein the base plate comprises a magnetic base plate.

* * * * *